United States Patent [19]

Vetter et al.

[11] Patent Number: 4,977,911

[45] Date of Patent: Dec. 18, 1990

[54] PROCESS AND DEVICE FOR CLEANING A SPRAYER

[75] Inventors: Kurt Vetter, Remseck; Michael Baumann, Flein; Thomas Hezel, Ingersheim, all of Fed. Rep. of Germany

[73] Assignee: Behr Industrieanlangen GmbH & Co., Bietigheim-Bissingen, Fed. Rep. of Germany

[21] Appl. No.: 322,564

[22] Filed: Mar. 13, 1989

[30] Foreign Application Priority Data

Mar. 16, 1988 [DE] Fed. Rep. of Germany ..... 3808801

[51] Int. Cl.[5] ..... B08B 3/02

[52] U.S. Cl. ..... 134/34

[58] Field of Search ..... 134/34, 99, 170, 171, 134/55

[56] References Cited

U.S. PATENT DOCUMENTS 4,456,022 6/1984 Roberts ..... 134/99

4,785,836 11/1988 Yamamoto ..... 134/170

FOREIGN PATENT DOCUMENTS 620630 5/1961 Canada ..... 134/99

*Primary Examiner*—Asok Pal

*Assistant Examiner*—Ourmazd Ojan

*Attorney, Agent, or Firm*—Reising, Ethington, Barnard, Perry & Milton

[57] ABSTRACT

The subject invention (1) provides a method and apparatus for cleaning the exterior of a sprayer in the area of its spray nozzle (2) and any existing air nozzles. The appropriate part (2) of the sprayer is inserted through an opening (4) in a container (3). All of the areas of the sprayer to be cleaned are directly charged with a cleaning fluid by a bow-shaped array of nozzles moving in a hemispherical path around the part (2) to be cleaned. The invention is particularly suited for the fully automatic cleaning of a spray gun mounted on a painting robot.

9 Claims, 1 Drawing Sheet

PROCESS AND DEVICE FOR CLEANING A SPRAYER

TECHNICAL FIELD

The subject invention relates to cleaning coating material from the exterior spraying surface of a sprayer deposited during a spray coating operation, and more particularly, to cleaning a sprayer mounted upon a painter robot.

BACKGROUND ART

Sprayers, such as spray guns for the dusting or fogging of paint in the coating of motor vehicle bodies or other production items, must be periodically cleaned, especially in the areas of paint nozzles and any air nozzles present. That is, they must be freed of any self-coating due to paint mist and drops of paint. From German Patent No. 2,854,325, it is known that the sprayer head of a paint spray gun can be freed of adhering spray material, such as paint or lacquer, after a predetermined operating time, by placing it into the opening of a receptacle cup and charging it with cleaning fluid sprayed from a stationary nozzle located in the center of the base of the cup. Inserting the sprayer head into the cup produces an airtight seal of the inner chamber of the latter. The mixture of cleaning fluid and paint residue collected inside the cup is suctioned off through a line. By spraying and flushing the exterior of the sprayer head inside a cleaning container effectively isolated from the outside, problems of environmental pollution by cleaning fluid and paint residue can be avoided.

SUMMARY OF THE INVENTION AND ADVANTAGES

The subject invention comprises a method of cleaning coating material from the exterior surface of the sprayer deposited during the spray coating operation comprising the steps of inserting the sprayer exterior surface to be cleaned into a cleaning chamber, spraying a cleaning medium at the exterior surface from an array of nozzles, and characterized by including the step of moving the array of nozzles in a path around the exterior surface while spraying the cleaning medium.

The subject invention also contemplates the cleaning apparatus for cleaning coating material from the exterior surface of a sprayer deposited during a spray coating operation, comprising a cleaning chamber presenting an opening for receiving the sprayer, a nozzle array disposed within the chamber and supported on at least one axis, and characterized by including drive means for moving the nozzle array on the axis to spray a cleaning medium at the exterior surface of the sprayer from continuously varying locations.

Fundamental to the invention is an objective of coating a process and a device, whereby the exterior of a spray gun or other sprayer device constantly subjected to the risk of self-coating, especially in the areas of its spray-material nozzle and any air nozzles present, can be cleaned in a time-saving manner, more thoroughly, and with the consumption of less cleaning medium that has heretofore been the case.

A significant additional advantage of the invention lies in the fact that the cleaning process can be simply controlled in a fully automatic manner. This is particularly important when the invention is used with painting robots, although significant advantages of the invention can also be realized in the cleaning of hand-held spray guns.

BRIEF DESCRIPTION OF THE DRAWING

Other advantages of the present invention will be readily appreciated as the same becomes better understood by reference to the following detailed description when considered in connection with the accompanying drawings wherein:

The drawing FIGURE is a schematic representation showing a cross section of a cleaning apparatus according to the subject invention.

DETAILED DESCRIPTION OF THE PREFERRED EMBODIMENT

Figure 1:
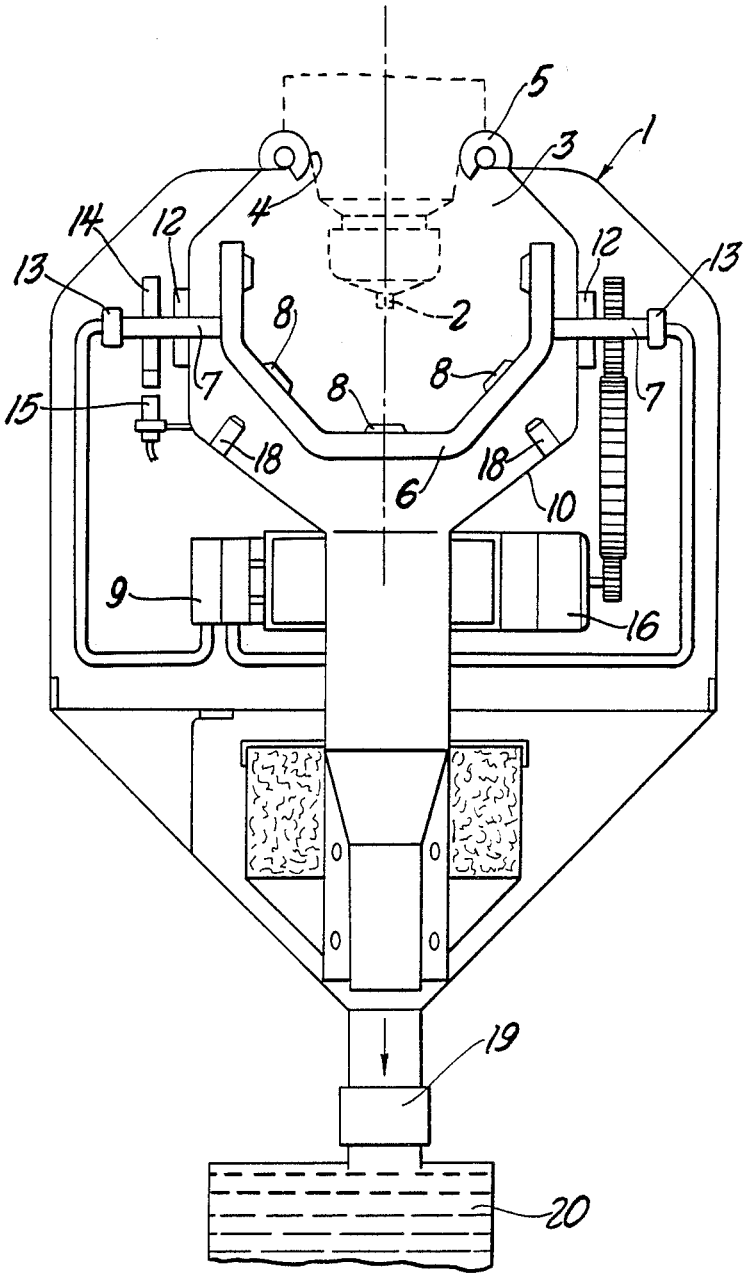

In extensively schematic presentation, the drawing depicts a device 1 for cleaning a spray gun 2 (indicated in broken outline). The cleaning device 1 has a container with an inner chamber 3 so designed that it is rotationally symmetrical on a usually vertical axis. On its upper side and concentric to its axis, the inner chamber 3 has an opening 4, through which the part of the spray gun 2 to be cleaned can be inserted into said chamber. The interstice between the spray gun 2 placed into the device 1 and the rim of the opening 4 can be closed by a sealing element 5, which prevents the emergence of cleaning fluid and paint residue. At the same time, the sealing element 5 provides positional centering, i.e., establishment of the cleaning position of the spray gun in the cleaning device 1. The sealing element is preferably so designed that unavoidable radial and axial positional changes between the spray gun 2 and the container of the cleaning device can be compensated. In the illustrated example, it consists of an elastic, bead-like lip gasket. The sealing element can also include a floating ring gasket in a receptacle contrivance (not illustrated).

Arranged inside the chamber 3 is a nozzle array 6, which can pivot on an axis running transversely to the axis of the container. The nozzle array 6 is secured by two shafts 7, which contain the lines for feeding the cleaning fluid to the nozzle array and are rotatably sealed off from the outside in two passageways 12. External feed lines are connected to the ends of the shafts 7 by a rotary seal 13. Supply of the cleaning fluid is regulated by valves 9 which are preferably magnetic valves, which facilitate automatic operation.

The nozzle array 6 contains several nozzles 8 or other jet-like apertures, through which cleaning fluid is sprayed onto the area of the spray gun 2 to be cleaned. It consists essentially of a generally U-shaped or approximately semicircular bow, which is pivotally mounted on an axis transversely extending through the two ends of the bow. The axis of the shafts 7 is so arranged that the spray gun 2 with its area to be cleaned protrudes into the space between the two arms of the bow. The bow can be pivoted by at least 180° , i.e., it can be swung around the end of the spray gun 2 protruding into the chamber 3 from its tip visible in the drawing to its back side, so that, during said pivoting movement, all points of all pertinent areas of the spray gun can be sprayed directly. Depending upon the design of the pivotable nozzle array, it can be advantageous that the spray gun 2 protrude into the chamber 3 to beneath the pivoting axis.

The nozzle array 6 is propelled by a pneumatically or an electrically powered drive means 16 coupled to one of the shafts 7, which drive means 16 is connected to a regulatory unit. The pivoting movement in both directions takes place in predetermined angular increments, which can be adjusted at the drive means 16. Affixed to the other shaft 7 is a positioning element 14, which provides, by way of a position sensor 15, information as to the existing position of the nozzle array 6. For reversal of the drive and returning the bow to its base position, the position sensor 15 can be equipped with two proximity initiators.

In other embodiment examples of the invention, in addition to the pivoting bow arrangement described above or some other movable array of nozzles, fixed nozzles can also be provided.

If no pivoting movement takes place, the bow is positioned in a lateral base position (not illustrated). With this configuration, e.g., cleaning or flushing fluid can be emptied from the interior of the spray gun 2, providing interior cleaning in the process, into the cleaning device 1. Interior cleaning of spray guns is known; however, here the advantage of unproblematic disposal of the flushing fluid is realized.

The used cleaning fluid flowing away from the spray gun is collected by a funnel-like part 10 of the inner chamber 3 and passed through the center of said funnel-like part into a collecting container 20. Preferably, the used cleaning fluid should constantly drain out of the inner chamber 3 during the spraying operation. When an automatic control valve 19 is provided between the inner chamber 3 and the collecting container 20, the collecting container 20 can, when the valve is closed, be emptied into a discharge line by means of compressed air. Instead, the emptying can also be accomplished by pressure reduction, i.e., by suction or pumping. The emptying operation can be regulated as to time and is preferably performed following completion of the cleaning operation, when possible at a time when the cleaned sprayer is back in operation.

The invention is particularly suited for the fully automatic, controlled cleaning of a sprayer used in conjunction with a painting robot or other program-controlled moving automaton. In such a case, the cleaning device itself can also be practically mounted on the robot. In operating the device, the part of the spray gun 2 to be cleaned is lowered by the robot from a defined entering position (preferably at a low rate of speed) perpendicularly through the opening 4 and into the device 1. Sensors (not illustrated) can report that the spray gun 2 has assumed the proper position. Via the nozzle array 6 and in keeping with a predetermined progression scheme, the spray gun is then charged with cleaning fluid as the pivoting bow executes its movement. Following its cleaning, the spray gun 2 is preferably blow-dried with compressed air, which is blown directly onto the sprayer head of the spray gun 2 from air nozzles 18 separately mounted on the wall of the inner chamber 3 and connected with an (unillustrated) air line. The air nozzles could also be mounted on the pivotable nozzle array 6. During the cleaning and the drying operations, any existing air holes (openings for horn and dusting air) in the exterior of the spray gun 2 can be protected against the intrusion of cleaning fluid and dirt residue from expelled air.

The progression scheme of the cleaning program should preferably follow a process control. Progressional regulation can also be assumed by the painting robot.

The described device makes possible a dependable cleaning of the spray gun in a short time and with minimal consumption of cleaning fluid. E.g., the cleaning of the spray gun can be completed within a time span of 5–7 seconds, while the consumption of cleaning fluid for a single cleaning operation can be in a range of 15–20 $cm^3$.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of cleaning coating material from the exterior surface of a sprayer deposited during a spray coating operation, comprising the steps of;

inserting the exterior surface of the sprayer to be cleaned into a cleaning chamber while maintaining a portion of the sprayer outside of the cleaning chamber;

perfecting a fluid-tight seal between the sprayer and the cleaning chamber;

spraying a cleaning medium at the exterior surface from an array of nozzles; and including the step of (oscillating) moving the array of nozzles in two directions in a path around the exterior surface while spraying the cleaning medium.

2. A method as set forth in claim 1 further characterized by controlling the duration of spraying the cleaning medium onto the exterior surface (2) of the sprayer to a predetermined period of time with a program control, directing waste cleaning medium from the chamber (3) to a collection container (20), and emptying the collected waste cleaning medium from the collection container 20.

3. A method as set forth in claim 1 further characterized by directing a stream of compressed air toward the exterior surface (2) of the sprayer after spraying with the cleaning medium.

4. A method as set forth in claim 2 further characterized by exerting a pressure onto the waste cleaning medium to empty the cleaning medium from the collection container (20) into a discharge line.

5. A method as set forth in claim 1 further characterized by emitting a flushing fluid from the sprayer into the chamber (3).

6. A method as set forth in claim 1 whereby the sprayer is disposed in the chamber (3) and extends along a longitudinal axis, further characterized by moving the nozzle array (6) about an axis (7) running transversely to the longitudinal axis.

7. A method as set forth in claim 1 further characterized by alternately rotating the nozzle array (6) about an axis (7) in controllable directions and at adjustable angular increments and maintaining the nozzle array (6) at a predetermined position of rest.

8. A method as set forth in claim 1 further characterized by trapping waste cleaning medium from the chamber (3), and collecting the medium in a collection container (20) disposed below the chamber (3).

9. A method for cleaning coating material from the exterior surface of a sprayer deposited during a spray coating operation, comprising the steps of;

inserting the exterior surface of the sprayer to be cleaned into a cleaning chamber;

spraying a cleaning medium at the exterior surface from an array of nozzles; and including the step of (oscillating) moving the array of nozzles in an two arcuate directions in a path around the exterior surface while spraying the cleaning medium.

* * * * *